US012104386B2

(12) United States Patent
Townsend

(10) Patent No.: US 12,104,386 B2
(45) Date of Patent: Oct. 1, 2024

(54) SYSTEM AND METHOD OF BALUSTER INSTALLATION

(71) Applicant: Jared Townsend, New Palestine, IN (US)

(72) Inventor: Jared Townsend, New Palestine, IN (US)

( * ) Notice: Subject to any disclaimer, the term of this patent is extended or adjusted under 35 U.S.C. 154(b) by 170 days.

(21) Appl. No.: 17/656,240

(22) Filed: Mar. 24, 2022

(65) Prior Publication Data

US 2022/0307267 A1 Sep. 29, 2022

Related U.S. Application Data

(60) Provisional application No. 63/165,995, filed on Mar. 25, 2021.

(51) Int. Cl.
*E04F 11/18* (2006.01)

(52) U.S. Cl.
CPC ..... *E04F 11/1846* (2013.01); *E04F 11/1812* (2013.01)

(58) Field of Classification Search
CPC . E04F 11/181; E04F 11/1812; E04F 11/1817; E04F 11/1842; E04F 11/1846; E04F 11/1814
USPC ..... 52/832
See application file for complete search history.

(56) References Cited

U.S. PATENT DOCUMENTS 3,973,756 A * 8/1976 Lauzier ..... E04F 11/181 256/65.11
6,311,957 B1 * 11/2001 Driscoll ..... E04F 11/1853 256/65.05
6,889,960 B1 * 5/2005 Jones ..... E04F 11/1817 411/510
11,225,798 B1 * 1/2022 Moeller ..... E04F 11/1846
2003/0164486 A1 * 9/2003 West ..... E04F 11/181 256/65.1
2006/0107613 A1 * 5/2006 Chung ..... E04F 11/1853 52/832
2006/0175592 A1 * 8/2006 DeRogatis ..... E04H 17/1439 256/59
2009/0173926 A1 * 7/2009 Timothy ..... E04F 11/181 256/65.02
2011/0271481 A1 * 11/2011 Ma ..... E04F 11/1817 52/749.1

(Continued)

OTHER PUBLICATIONS

How To Install: Iron Balusters, dated Oct. 22, 2020, https://www.youtube.com/watch?v=mhvTY675n-s.

(Continued)

*Primary Examiner* — Kyle J. Walraed-Sullivan

(74) *Attorney, Agent, or Firm* — Woodard, Emhardt, Henry, Reeves & Wagner, LLP; William A. McKenna; Andrew M. Nevill

(57) ABSTRACT

A baluster support sleeve for securing a baluster to a stair includes a body including an outer surface and an alignment wing extending from the outer surface. The alignment wing is designed to secure the baluster support sleeve within an installation hole defined in a stair. A baluster recess is defined through the body and interior walls surround the baluster recess. A lower end of a baluster may be received within the baluster recess. The baluster may be secured within the baluster recess and raised into position within a banister to form a handrail for a stairway.

17 Claims, 4 Drawing Sheets

(56) References Cited

U.S. PATENT DOCUMENTS

| | | | | |
|---|---|---|---|---|
| 2015/0102277 | A1* | 4/2015 | Milanowski | E04F 11/1842 256/65.02 |
| 2015/0115214 | A1* | 4/2015 | Schneider | E04F 11/1844 256/67 |
| 2016/0160525 | A1* | 6/2016 | Milanowski | E04H 17/1447 256/65.12 |
| 2018/0030734 | A1* | 2/2018 | Guo | E04F 11/1812 |
| 2020/0040587 | A1* | 2/2020 | Yu | E04F 11/1812 |
| 2020/0277793 | A1* | 9/2020 | Calderone | E04F 11/1846 |
| 2022/0243477 | A1* | 8/2022 | Barnds | E04F 11/1817 |

OTHER PUBLICATIONS

Iron Baluster Installation/Easy DIY Re-Secure *No Glue*: Measure, Cut, Install, Staircase Update! dated Oct. 21, 2020, https://www.youtube.com/watch?v=bnAtHoLXaqE.

* cited by examiner

SYSTEM AND METHOD OF BALUSTER INSTALLATION

CROSS REFERENCE TO RELATED APPLICATIONS

This application claims the benefit of U.S. Provisional Patent Application Ser. No. 63/165,995 filed on Mar. 25, 2021, which is hereby incorporated by reference.

FIELD OF THE INVENTION

The present invention herein pertains to stairway balusters and particularly pertains to a device for enabling wrought iron stairway balusters to be easily installed, exchanged or replaced during construction, remodeling or redecorating the interior of a building such as a house or commercial space.

BACKGROUND OF THE INVENTION

Many homes, offices and other finished commercial spaces utilize stairway handrails and decorative balusters. These balusters are often made from wood or wrought iron. Traditionally, installation involved the creation of equally spaced ¾" holes in the stair treads or floor cap where the balusters were to be secured. Each baluster was then cut to length, inserted into the proper hole and secured within the existing hole using either liquid adhesive, epoxy or a general fastener such as a screw at the base. The baluster is the securing in place at the top within the handrail using a similar technique. In the case of wrought iron or certain other balusters, a matching shoe is slid down the baluster and secured in place against the stair tread or floor cap to conceal the unfinished end of the baluster and the mounting hole.

Whether installed as part of new construction, as part of a remodel or simply being repaired due to damaged which occurs, each baluster is typically installed according to the procedure above with the use of nails, screws, or adhesives. These methods leave the balusters being difficult to remove, and in the case of adhesives, create the potential for unintended damages or mess to the surrounding surfaces, which are often finished. These installation methods are also labor intensive.

In view of the problems and difficulties associated with the installation removal and repair of standard stairway balusters, the present invention was conceived and one of its objectives is to provide a device for securing at least the lower end of the baluster without the need for adhesives, screws or the like to provide convenience in the repair, installation or removal process.

It is a further objective of the present invention to provide a method of baluster installation which allows one or more balusters to be exchanged, replaced and installed in a quick and efficient manner by those with relatively little training or skill.

What is needed is a baluster installation device which may be readily secured to the ¾" holes traditionally found or created in the stair tread or floor cap where the lower end of the balusters are to be mounted and serves to securely retain the baluster in the desired orientation.

SUMMARY

Certain embodiments include a baluster support sleeve for securing a baluster to a stair and a method of installing a baluster to a stair using the baluster support sleeve. The baluster support sleeve may include a body having an outer surface and a baluster recess defined through the body. One or more interior walls surround the baluster recess. In some instances, the body of the baluster support sleeve may be cylindrical and the baluster recess may be square shaped.

An alignment wing extends from the outer surface of the body and the alignment wing may be used to secure the baluster support sleeve to the stair. In some instances, more than one alignment wing may extend from the outer surface of the body of the baluster support sleeve. In some embodiments, the alignment wing is a radial extension that runs along a length of the height of the body, and in some instances, the alignment wing may run along the entire length of the height of the body. In some examples, the alignment wing may have a triangular shape. In other examples, the alignment wing may be in the form of one or more ribs that run around at least a portion of a circumference of the outer surface of the body.

In some embodiments, at least one of the interior walls of the baluster support sleeve may be made from a compressible material that is able to conform to a baluster inserted into the baluster recess to secure the baluster within the baluster recess. In other embodiments, a retaining clip may be positioned on one of the one or more interior walls and may be used to secure a baluster within the baluster recess.

A method of installing balusters on a staircase may comprise orienting a baluster support sleeve with respect to an installation hole. The baluster support sleeve may include a body including an outer surface, a baluster recess defined through the body, and an alignment wing extending from the outer surface of the body. Once aligned, the baluster support sleeve may then be driven into the installation hole. The installation hole may be defined through a support surface, such as a stair tread. A lower end of a baluster is then fit into the baluster recess of the baluster support sleeve and the upper end of the baluster is secured to a banister.

In some embodiments, the method may include forming the installation hole in stair, such as in the tread of the stair. Additionally, in other embodiments, a boot may be slid over the baluster so that the boot is supported by a stair and so that the boot covers the baluster support sleeve. The baluster may be further secured within the baluster recess using a clip, or in some examples the baluster may be secured by a compressible material surrounding the baluster recess that conforms to the shape of the baluster.

Further forms, objects, features, aspects, benefits, advantages, and embodiments of the present invention will become apparent from a detailed description and drawings provided herewith.

DETAILED DESCRIPTION OF THE SPECIFIC EMBODIMENTS

Figure 1:
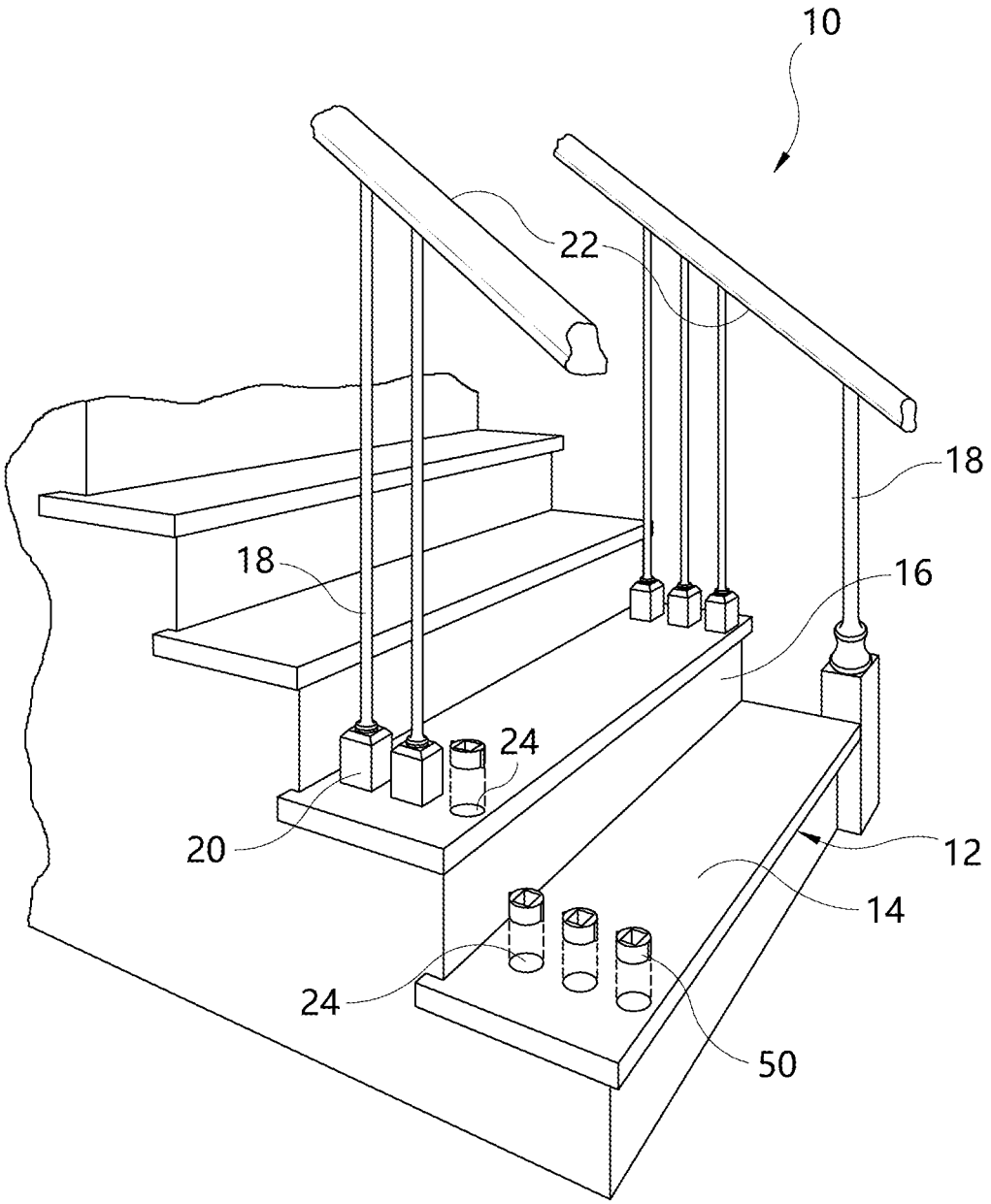
FIG. 1 is a perspective view showing a traditional staircase having wrought iron balusters partially installed.

For the purposes of promoting and understanding of the principles of the invention, reference will now be made to the embodiment illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In certain embodiments of the present invention, a baluster support sleeve for use in securely installing balusters is disclosed. The baluster support sleeve includes an inner recess for retaining a baluster at its lower end. While the baluster support sleeve may be configured to retain various forms of balusters, for purposes of illustration the configuration suitable for use with a conventional wrought iron baluster will be illustrated.

Illustrated in FIG. 1 is a perspective view of a traditional staircase 10 having steps 12, treads 14, and risers 16 as is conventional in the trade. Affixed to treads 14 are a series of balusters 18 using baluster support sleeves 50 as will be explained hereinafter in more detail. As shown, handrail 22 is attached to baluster 18 and as would be understood would be connected to all balusters 18 where appropriate in actual use. All shown balusters 18, steps 12 and handrails could be collectively or individually formed from wood, metal or composites as desired. Each baluster 18 also includes a boot 20 which is typically slid over the baluster 18 prior to installation and then slide into position against the lower support surface, which in this case is the treads 14. In many forms, the boot 20 is secured in position through the use of a small set screw, but other methods of securement may be provided for.

For purposes of illustration, several balusters 18 are shown as missing is FIG. 1. In their place, installation holes 24 are formed in the lower support surface, which in this case is the treads 14. These installation holes 24 are traditionally formed in baluster installation and as such may be already present in the case of a retrofit or remodel. Alternatively, in the case of new construction, the placement and creation of these installation holes 24 will be familiar to those in the trade. In the trade, the standard sizing for installation holes is ¾" diameter, however, it shall be appreciated that alternate sizes may be utilized, including ¾", ⅜", ½", ⅝", 1" and the like as non-limiting examples. Other sizes, including metric sizes, are contemplated, but for purposes of standardization, the ¾" size is the most common.

Shown above installation holes 24 is a baluster support sleeve 50, which is shown in further detail in the remaining figures. It shall be appreciated that baluster support sleeve 50 is sized so as to be compatible with the size of selected or existing installation holes 24. The baluster support sleeve 50 is positioned within the installation hole 24 and provides support for the lower end of the baluster 18. When the boot 20 is slide down to the lower support surface, such as tread 14 in the case of stairwell 10, then the installation hole 24 and baluster support sleeve 50 are hidden for a finished appearance.

It shall be appreciated that stairwell 10 is representative of a staircase that may be utilized in a home, office or in any finished space, such as a commercial space and that the present invention may be readily modified to accommodate the needs of any other staircase design or other baluster installation point, such as on a deck, railing or the like.

Figure 2:
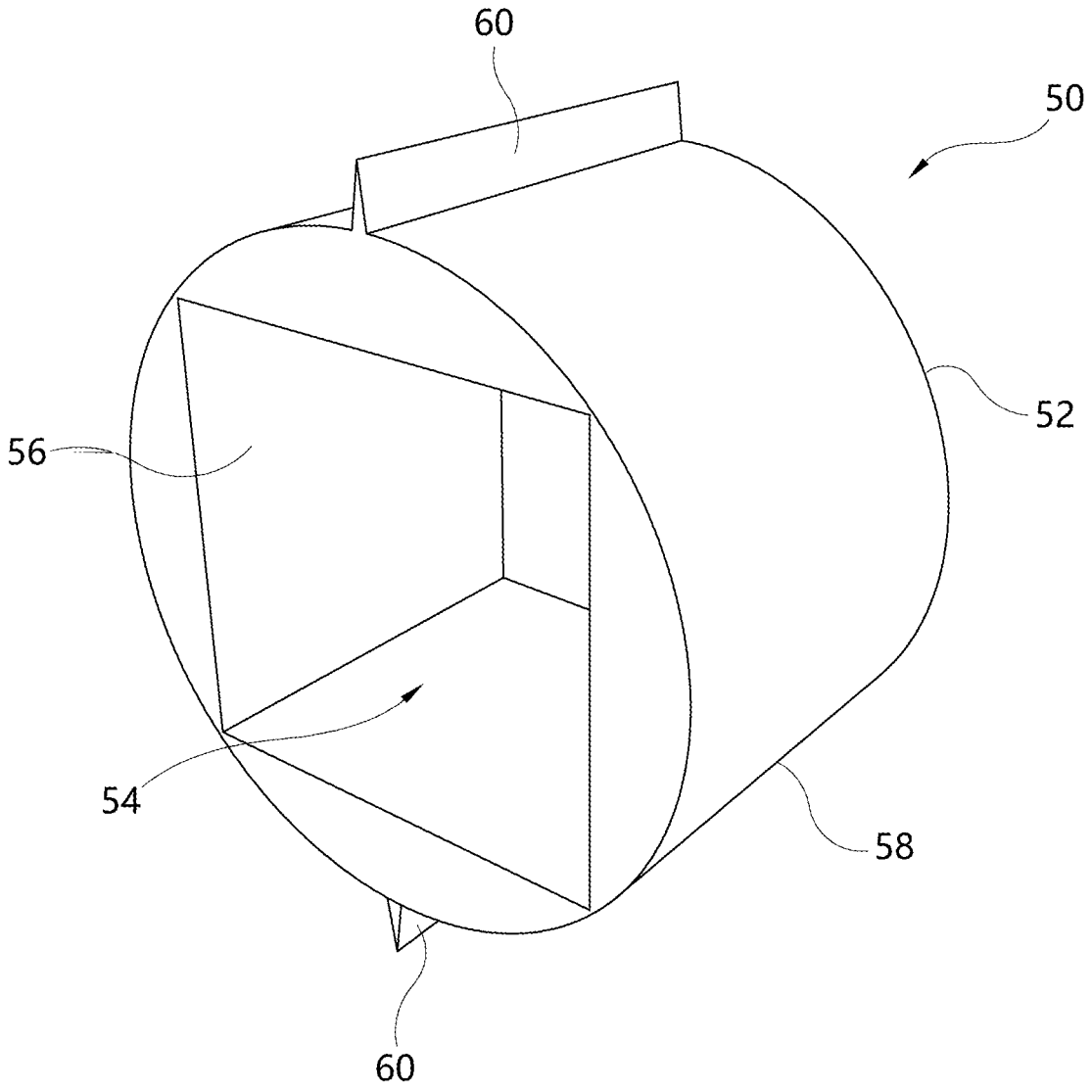
FIG. 2 is a perspective view showing a baluster support sleeve according to one embodiment of the present invention.
Figure 3:
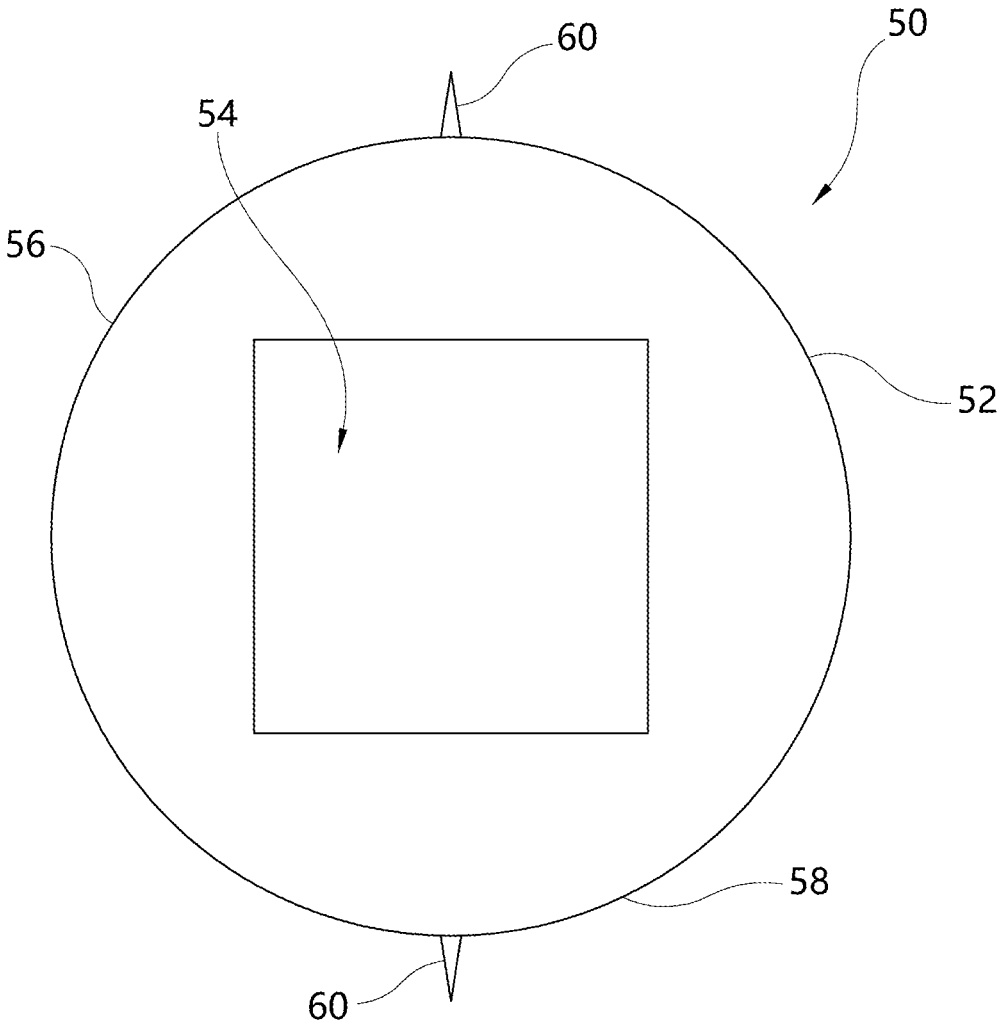
FIG. 3 is a top plan view showing the baluster support sleeve shown in FIG. 2.
Figure 4:
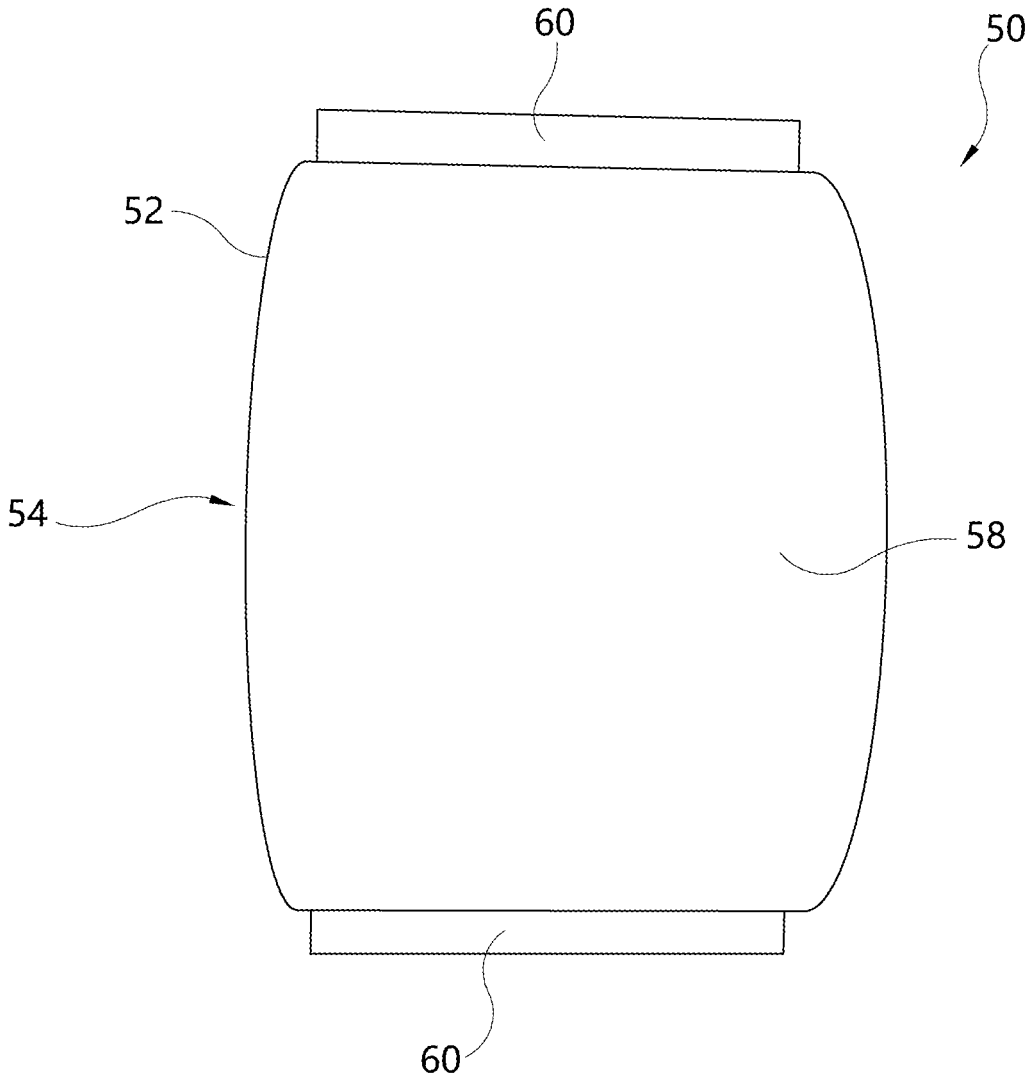
FIG. 4 is a side plan view showing the baluster support sleeve shown in FIG. 2.

Turnings to FIG. 2-4, a baluster support sleeve 50 according to one form of the present invention is illustrated. Baluster support sleeve 50 includes a body 52, which may be made of metal, such as steel aluminum or the like, or some other desired material such as plastic. Body 52 has a cylindrical outer profile. In one form, body 52 measures ¾" in diameter or approximately ¾" in diameter so as to fit securely within a ¾" diameter hole, such as installation holes 24 of FIG. 1. It shall be appreciated that alternate sizes may be utilized, including ¾", ⅜", ½", ⅝", 1" and the like as non-limiting examples. Other sizes, including metric sizes, are contemplated, but for purposes of standardization, the ¾" size is the most common.

Within body 52 is a baluster recess 54 which is sized so as to securely receive and retain the desired baluster. In the case of wrought iron, baluster lower ends are traditionally square shapes and measure ½" by ½". As such, in the illustrated embodiment, baluster recess 54 is a ½" by ½" square or approximately a ½" by ½" centrally located in the body 52. Baluster recess 54 includes four walls 56 which mate with and serve to secure the baluster when installed as shown in FIG. 1. In further forms, one or more of walls 56 may include a damping or compressible material to ensure a snug fit between the baluster and the baluster recess 54. In yet another form, one or more of walls 56 or body 52 may include a retaining clip or other mechanism to secure the baluster within the baluster recess 54.

Also provided for on the outer surface 58 of baluster support sleeve 50 is at least one alignment wing 60 which serves to secure baluster support sleeve 50 within the stair tread 14 or whichever other lower support surface is being utilized for a given installation. Alignment wing 60 also serves to maintain baluster support sleeve 50 in the orientation desired, which in the case of many balusters designs will ensure that the balusters are all facing as intended. Alignment wing 60 is shown as a thin radial extension protruding from the outer surface 58 of baluster sleeve 50 and running the entire length or substantially the entire length of the height of body 52, but may take other shapes and sizes depending upon the lower surface to which it will be installed. For example, the alignment wing 60 may run the length or only a portion of the height of body 52. As illustrated, alignment wing 60 has a triangular shape, but may have sides of a sloped or arcuate shape. In the case of a wooden lower support surface, the alignment wing(s) 60 may bite into the grain of the wood and secure itself therein. Given this, to install the baluster support sleeve 50 the installer would need to properly alight the baluster support sleeve 50 and then drive it into the lower support surface such as by using a hammer, rubber mallet or the like. More than one alignment wing 60 may be provided for, as is illustrated in FIGS. 2-4.

It shall be appreciated that in other form of the invention baluster support sleeve 50 may utilize one or more alternative or additional methods to secure itself within installation hole 24 in the lower support surface. For example, body 52 may utilize a friction fit, body 52 may include one or more ribs running around at least a portion of the circumference of body 52 along its exterior surface 58, one or more vertical ribs running up the sides of exterior surface 58 along the height of body 52, one or more protuberances may be provided on exterior surface 58 and/or body 52 may have a tapered profile with a growing diameter from one end to the other in order to provide for a tight fit. While not preferred due to their potential for mess as outlined above, adhesives may also be utilized between the lower portion and sides of the installation hole 24 and baluster support sleeve 50.

During a new construction, remodeling or retrofitting, the method for installing balusters, such as baluster 18, requires the forming or prior establishment of installation holes 24 in the appropriate locations on stair tread 14 with the handrail 22 above also being properly prepared for receiving baluster 18. Baluster support sleeve is then oriented properly above a selected installation hole 24 and driven down into the installation hole 24. The baluster 18 then has its boot 20 slid thereon in the proper direction and the lower end of baluster 18 is slid into the baluster recess 54, which ensures its proper alignment. As described above, the baluster may be secured therein using a clip or the like if provided as part of baluster support sleeve 50. The baluster 18 is then raised into position within banister 22 and the top end of baluster 18 is secured in place therein in one of several traditional ways. There is no need for the installed to hold the baluster 18 in position while waiting for any adhesive to dry or to drive any screws or the like which might split the wood or kick the baluster out of alignment. Rather, the installer may immediately proceed to lower the boot 20 into place at the lower end of baluster 18 and against the stair tread 14 to cover up the installation hole 24 and baluster support sleeve 50 so as to provide a finished appearance. Often, the boot 20 is secured in place by the tightening of a small set screw. By saving significant time on each baluster 18, the labor costs of installation can be significantly reduced while providing a more secure and reliable baluster.

In the event of a remodel, the process is significantly easier than the above as all the installer would need to do is to remove the boots 20 and pull the balusters 18 and install new ones, provided that the shape of the lower end of both the old and new balusters is consistent. Compared with the conventional method of installation, which would require large amounts of old adhesive to be removed from each installation hole 24, the installer who previously used baluster support sleeves 50 would not be required to any clear-up or re-do any of the installation work for the baluster support sleeves 50, thereby offering a tremendous time and money savings, as well as reducing dusk and other materials for creating a significant mess in an already finished space.

The embodiments of the baluster support sleeve 50 has been shown and described herein is configured to be securely positioned within a stair tread, knee wall, floor cap or the like. The baluster support sleeve may be provided in different shapes and sizes depending upon the baluster size and type as well as the type of base into which the baluster is to be installed. For example, the baluster support sleeve may have an outer diameter or approximately ¾" so as to fit securely within a conventional ¾" baluster hole which is commonly present in retrofits and drilling during new installations. Additionally, the inner recess of the baluster support sleeve may be square shaped and sized so as to securely receive a conventional ½"×½" wrought iron baluster or the like. It shall be appreciated that the conventional sizes disclosed and referenced herein may be modified to meet whatever alternate and/or custom needs may be desired.

The baluster support sleeve 50 may also come in a number of different arrangements so as to be usable with various baluster arrangements, including mounting the baluster directly to the open stair ends as will be shown in FIG. 1, mounting the balusters to a flat or raked knee wall, mounting the balusters to a floor cap, or any other known or alternate baluster arrangement. In such event, the axis of the inner recess may be offset relative to the axis of the baluster support sleeve and the baluster hole set into a raked knee wall and the top of the baluster support sleeve 50 may be sloped with the appropriate rake as opposed to being flat.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the inventions as described herein and/or by the following claims are desired to be protected.

Hence, the proper scope of the present invention should be determined only by the broadest interpretation of the appended claims so as to encompass all such modifications as well as all relationships equivalent to those illustrated in the drawings and described in the specification.

What is claimed:

1. A baluster support sleeve for securing a baluster to a stair within an installation hole having a first diameter, said baluster support sleeve comprising:

a body including an outer surface less than or equal to the first diameter;

a baluster recess defined through said body, wherein one or more interior walls surround said baluster recess; and, an alignment wing extending from said outer surface of said body and beyond the first diameter, wherein said alignment wing is configured to secure the baluster support sleeve to the stair by being driven directly down into the stair surrounding the installation hole without rotation of the baluster support sleeve.

2. The baluster support sleeve of claim 1, wherein said alignment wing is a radial extension that runs along a length of the height of said body.

3. The baluster support sleeve of claim 2, wherein said alignment wing runs along the entire length of the height of said body.

4. The baluster support sleeve of claim 1, wherein said alignment wing has a triangular shape.

5. The baluster support sleeve of claim 1, wherein a plurality of alignment wings extend from said outer surface of said body.

6. The baluster support sleeve of claim 1, wherein at least one of said one or more interior walls is made from a compressible material configured to conform to a baluster inserted into said baluster recess to secure the baluster within said baluster recess.

7. The baluster support sleeve of claim 1, wherein the baluster recess is square shaped.

8. The baluster support sleeve of claim 1, wherein said body is cylindrical.

9. A method of installing a baluster comprising:

orienting a baluster support sleeve with respect to an installation hole within a stair, the installation hole having a first diameter, wherein said baluster support sleeve includes a body including an outer surface with a diameter less than or equal to the first diameter, a baluster recess defined through said body, and an alignment wing extending from said outer surface of said body outward beyond the first diameter;

driving said baluster support sleeve into said installation hole and said alignment wing into the stair surrounding the installation hole using a downward force into the installation hole and without rotating said baluster support sleeve;

fitting a lower end of a baluster into said baluster recess of said baluster support sleeve;

securing an upper end of said baluster to a banister.

10. The method of claim 9, further comprising:

forming an installation hole in a stair having the first diameter.

11. The method of claim 9, further comprising:

sliding a boot over said baluster so that said boot is supported by a stair and so that said boot covers said baluster support sleeve.

12. The method of claim 9, further comprising:

securing said baluster within said baluster recess.

13. The method of claim 12, wherein said baluster is secured within said baluster recess by a compressible material surrounding said baluster recess that conforms to the shape of said baluster.

14. The method of claim 9, wherein said alignment wing is a radial extension that runs along a length of the height of said body.

15. The method of claim 14, wherein said alignment wing runs along the entire length of the height of said body.

16. The method of claim 9, wherein said alignment wing has a triangular shape.

17. The method of claim 9, wherein a plurality of alignment wings extend from said outer surface of said body.

* * * * *